US005092257A

United States Patent [19]

Ogawa

[11] Patent Number: 5,092,257

[45] Date of Patent: Mar. 3, 1992

[54] AUTOMATIC THREADING APPARATUS ON A SEWING MACHINE

[75] Inventor: Masao Ogawa, Nagoya, Japan

[73] Assignee: Brother Kogyo Kabushiki Kaisha, Nagoya, Japan

[21] Appl. No.: 583,557

[22] Filed: Sep. 17, 1990

[30] Foreign Application Priority Data

Oct. 19, 1989 [JP] Japan ..... 1-272727

[51] Int. Cl.[5] ..... D05B 87/02

[52] U.S. Cl. ..... 112/225

[58] Field of Search ..... 112/220, 224, 225, 237, 112/238, 239, 240, 241, 254, 284, 302

[56] References Cited

U.S. PATENT DOCUMENTS

| | | | |
|---|---|---|---|
| 1,779,238 | 10/1930 | Howard | 112/225 |
| 2,704,526 | 3/1955 | Benink et al. | 112/225 |
| 2,727,479 | 12/1955 | Meissler | 112/225 |
| 2,739,553 | 3/1956 | Zink et al. | 112/225 |
| 2,815,725 | 12/1957 | Clauss et al. | 112/225 |
| 2,910,029 | 10/1959 | Herbst | 112/225 |
| 3,002,476 | 10/1961 | Capelli | 112/225 |
| 4,355,591 | 10/1982 | Itoh et al. | 112/225 |
| 4,459,927 | 7/1984 | Kurland et al. | 112/237 |
| 4,651,660 | 3/1987 | Oshima et al. | 112/225 |
| 5,003,899 | 4/1991 | Ogawa | 112/225 X |

FOREIGN PATENT DOCUMENTS

| | | |
|---|---|---|
| 63-46197 | 2/1988 | Japan . |
| 1113092 | 5/1989 | Japan . |

*Primary Examiner*—Werner H. Schroeder
*Assistant Examiner*—Ismael Izaguirre
*Attorney, Agent, or Firm*—Oliff & Berridge

[57] ABSTRACT

In the automatic threading device for the sewing machine, the treading rod is lowered and rotated, and the threading hook is automatically inserted into and through the needle eye. However, if the presser-foot detector detects the presser-foot is lowered, the threading rod is prohibited from being operated. Alternatively, if the operation detector detects the sewing-machine motor is being operated, the threading rod is prohibited from being operated. Consequently, even if the operator by mistake presses the threading switch during sewing operation when the presser foot is lowered or the sewing-machine motor operates, the threading rod is prohibited from being driven. Therefore, the threading hook is prevented from being damaged. The threading switch can be provided on the front panel of the sewing machine, near the start-stop switch or in any other easily accessible position.

15 Claims, 5 Drawing Sheets

AUTOMATIC THREADING APPARATUS ON A SEWING MACHINE

BACKGROUND OF THE INVENTION

This invention relates to a device that can automatically thread an eye of a needle on a sewing machine.

Threading the needle of a sewing machine is a troublesome operation. To facilitate threading, various threading devices are proposed, for example, in Japan Published Unexamined Patent Application Nos. S63-46197 and H1-113092, in which a spring exerts an upward force on an actuating rod. The actuating rod is lowered manually or automatically through an air cylinder. A threading rod interlocks with the actuating rod, lowers, and further rotates. A threading hook thus extends through a needle eye and catches the thread. Subsequently, when the threading hook leaves the needle eye, one end of the thread is drawn into and through the needle eye.

However, in the related-art references, if an operator by mistake lowers a manual threading lever or presses a threading switch during sewing operation, a threading rod rotates. The threading hook moves toward the needle, which is vertically moving according to the operation of a sewing-machine motor, and may break upon contact with the needle. To avoid such malfunction, the manual threading lever and the threading switch are provided on the upper left side, under the face plate, or in another position of the sewing machine that the operator must take care to locate or cannot easily access.

SUMMARY OF THE INVENTION

The object of this invention is to provide an automatic threading device that can easily thread a needle without accidental or incorrect operation by the operator.

To attain this and other objects, this invention provides an automatic threading apparatus for a sewing machine. The sewing machine has a needle for sewing a cloth, a motor for driving the needle to sew the cloth, and a presser foot for pressing the cloth to hold the cloth steady when the needle is sewing the cloth. The automatic threading apparatus comprises a threading rod supported by the sewing machine such that the threading rod is movable along and rotatable about an axis of the threading rod, drive means for moving the threading rod along and rotating the threading rod about the threading rod axis, threading means attached to one end of the threading rod, where the threading means extends a threading hook into an eye of the needle when the drive means moves the threading rod along the threading rod axis and rotates the threading rod about the threading rod axis, detection means for detecting that the needle is sewing the cloth, and prohibiting means for prohibiting the drive means from lowering the threading rod when the detection means detects that the needle is sewing the cloth.

DETAILED DESCRIPTION OF THE PREFERRED EMBODIMENT

Figure 1:
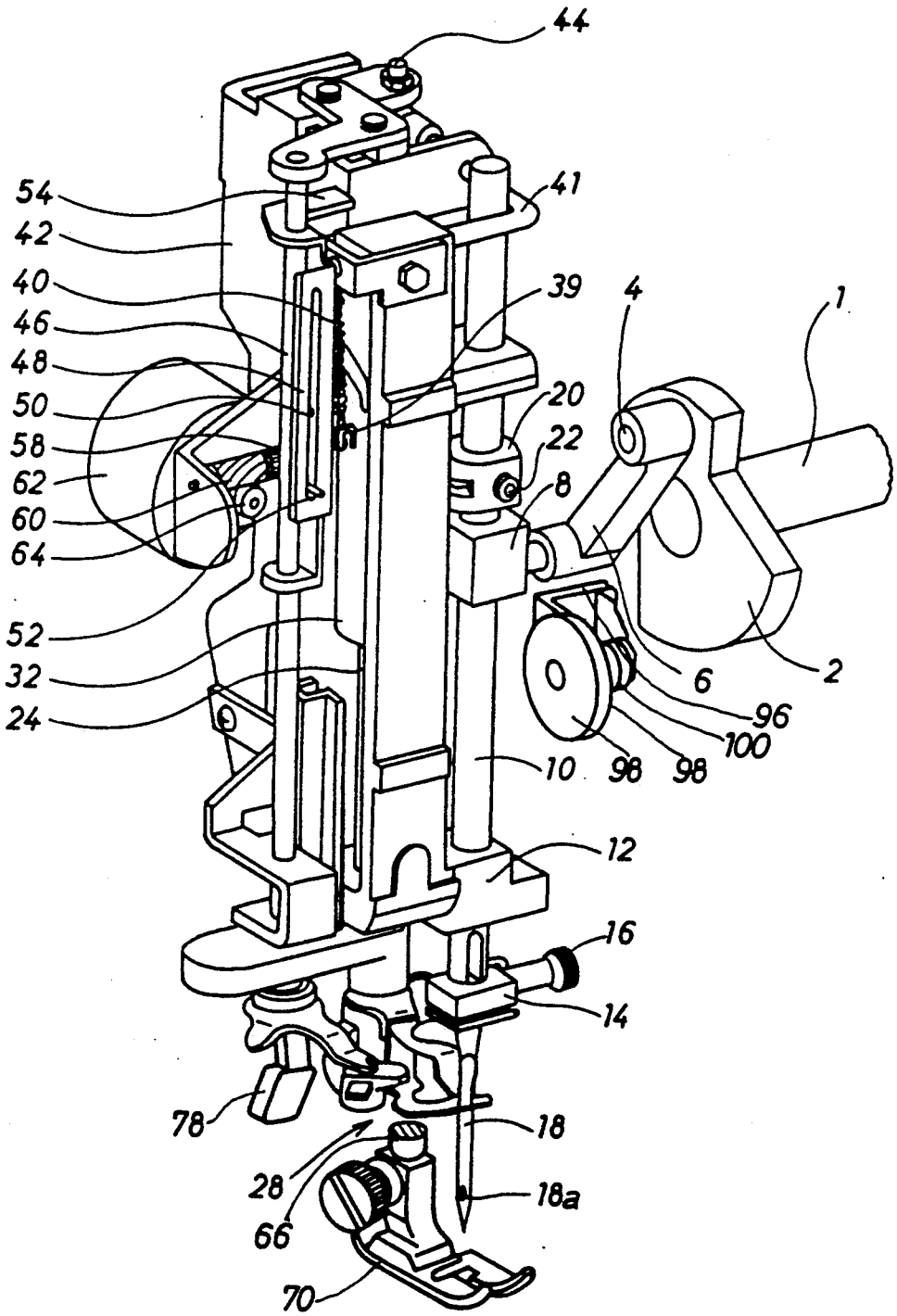
FIG. 1 is a perspective view of an automatic threading device on a sewing machine for an embodiment of this invention.
Figure 2:
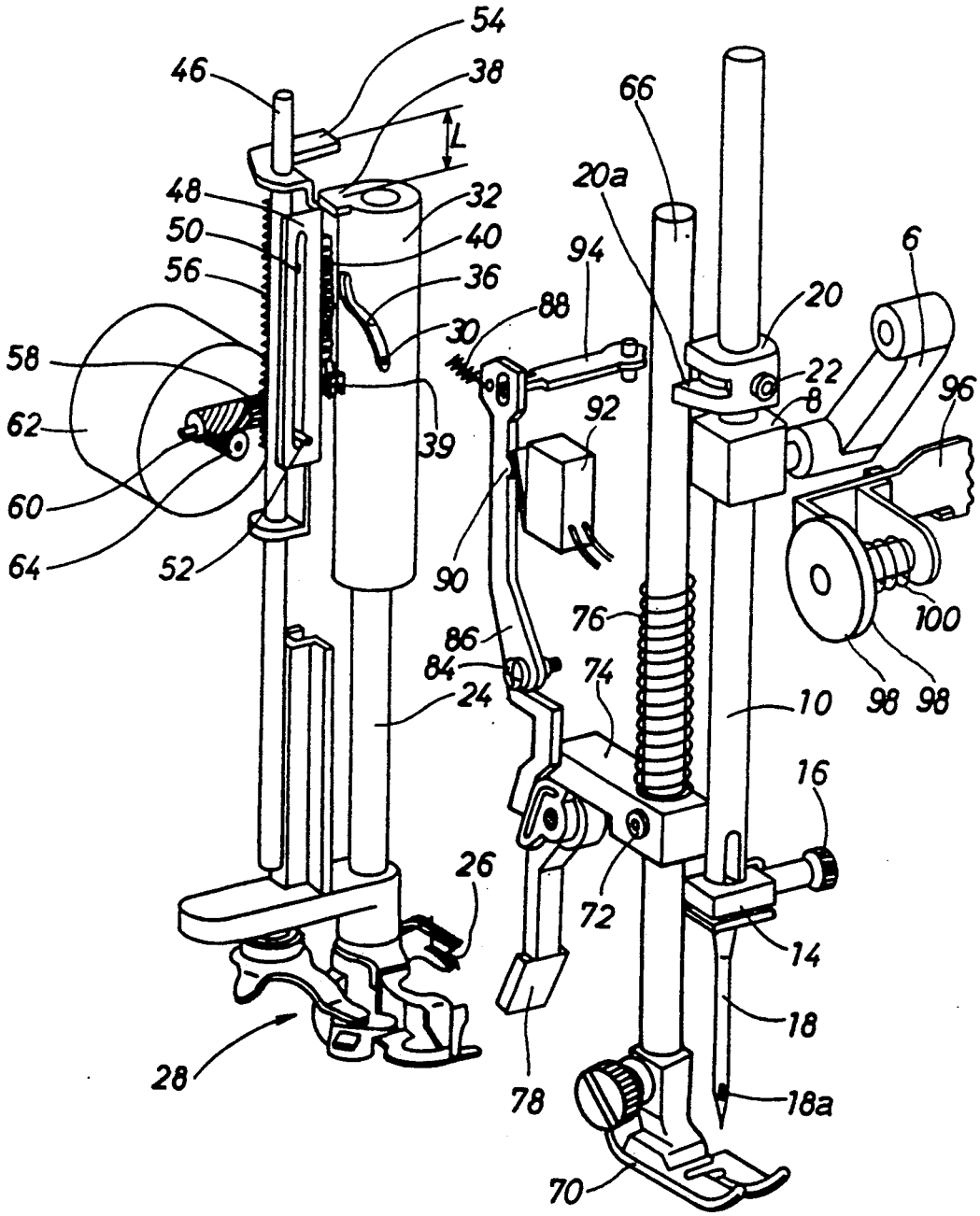
FIG. 2 is a perspective view of a disassembled main portion of the device shown in FIG. 1.

As shown in FIG. 1, an automatic threading device is connected to an arm shaft 1. The arm shaft 1 is rotated by a sewing-machine motor (not shown). A crankpin 4 is set on a counterbalance 2 attached to the arm shaft 1. One end of a connecting rod 6 is rotatably inserted into the crankpin 4. The other end of the connecting rod 6 is rotatably inserted into a needle-bar connecting stud 8. The needle-bar connecting stud 8 is secured to a needle bar 10. A needle bar support 12 supports the needle bar 10 such that the needle bar 10 can vertically slide. A needle 18 is attached via a needle connecting stud 14 and a clamp screw 16 to the lower end of the needle bar 10. A positioning stopper 20 is secured by a screw 22 to a predetermined position on the needle bar 10 above the needle bar connecting stud 8. As shown in FIG. 2, a projection **20*a* projects from the positioning stopper 20 perpendicularly to the axis of the needle bar 10**.

A threading rod 24 extends in parallel with the needle bar 10 on the needle bar support 12 such that the threading rod 24 can rotate about its axis and slide vertically. As shown in FIG. 2, the threading rod 24 has a threading hook 26 on its lower end. When the threading rod 24 rotates about its axis, the threading hook 26 is rotated by a known linkage 28 toward an eye **18*a* in the needle 18**.

Figure 3:
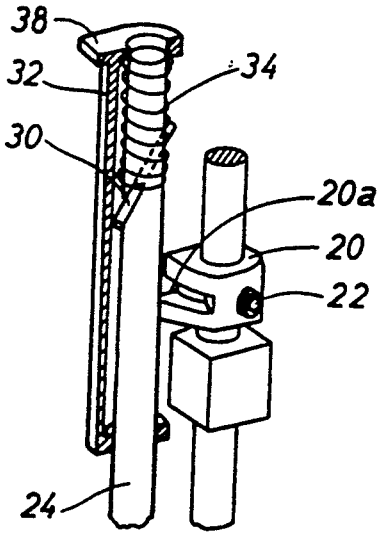
FIG. 3 is a partial perspective view of a positioning stopper and its adjoining components for the embodiment.

As shown in FIG. 3, an actuating pin 30 is inserted through the upper end of the threading rod 24 such that the actuating pin 30 is perpendicular to the axis of the threading rod 24. When the threading rod 24 lowers, the actuating pin 30 touches the projection **20*a* of the positioning stopper 20 to stop the threading rod 24. The positioning stopper 20 is secured by the screw 22 at the predetermined position on the needle bar 10 such that when the actuating pin 30 touches the projection 20*a*, the threading hook 26 is aligned with the eye 18*a* in the needle 18**.

An actuating rod 32 is slidably inserted onto the threading rod 24. A compression spring 34 is interposed between the actuating pin 30 and the actuating rod 32. As shown in FIG. 2, a guide slot 36 forms an S-shaped arc extending upward along the outer periphery of the actuating rod 32. One end of the actuating pin 30 engages the guide slot 36. A contact surface 38 is formed on the upper end of the actuating rod 32 and projects from the radius of the threading rod 24. A hook 39 is formed on the outer periphery of the actuating rod 32. A spring 40 extends between the hook 39 and a hook (not shown) formed as one piece with the needle bar support 12. The spring 40 exerts an upward force to the actuating rod 32.

As shown in FIG. 1, one end of an L-shaped member 41 is rotatably attached to the upper end of the needle bar support 12. The other end of the L-shaped member 41 is rotatably attached by a screw 44 into a threading housing 42 secured to a sewing-machine housing (not shown). A guide bar 46 is secured in parallel with the threading rod 24 onto the threading housing 42. A moving board 48 is slidably attached to the guide bar 46, separate from the actuating rod 32.

The moving board 48 includes a slot 50 extending along the sliding direction of the moving board 48. A pin 52 on the guide bar 46 engages the slot 50, thus preventing the moving board 48 from rotating. A projection 54 is formed on the upper end of the moving board 48. When the moving board 48 slides down toward the actuating rod 32, the projection 54 touches the contact surface 38 of the actuating rod 32 at a certain point. When the moving board 48 is in its uppermost position as shown in FIG. 2, the projection 54 is a predetermined distance L away from the contact surface 38, or the projection 54 can be in contact with the contact surface 38.

The moving board 48 includes a rack 56. The teeth of the rack 56 are formed orthogonal to the sliding direction of the moving board 48. The rack 56 meshes with a pinion 58. The pinion 58 and a helical gear 60 form one member and are rotatably supported on the threading housing 42. A worm gear 64 is attached to a rotating shaft of a pulse motor 62 on the threading housing 42 such that the worm gear 64 meshes with the helical gear 60.

Figure 4:
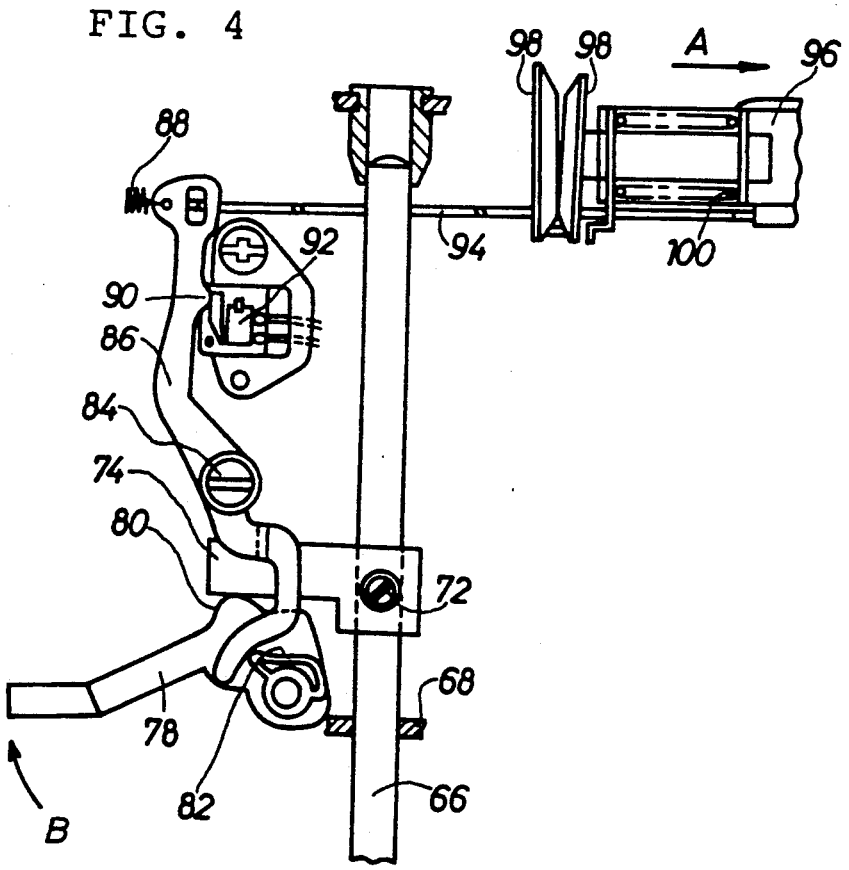
FIG. 4 is an explanatory view showing operation of thread tension discs through a lifting lever for the embodiment.

As shown in FIGS. 2 and 4, a presser bar 66 is supported in parallel with the needle bar 10 by a sewing-machine frame 68. The presser bar 66 has on its lower end a presser foot 70 for holding the cloth steady. A presser-bar connecting std 74 is secured by a screw 72 onto the presser bar 66. A coil spring 76 is wound around the presser bar 66 such that the coil spring 76 presses downward the presser bar 66 through the presser-bar connecting stud 74.

A lifting lever 78 rotatably supported on the sewing-machine frame 68 includes a presser-bar lifter cam 80 for contacting the underside of the presser-bar connecting stud 74. When the lifting lever 78 is rotated clockwise as shown by an arrow B in FIG. 4, the lifting lever 78 raises the presser bar 66 against the force of the coil spring 76 by contacting the presser-bar connecting stud 74. The lifting lever 78 also includes a thread tension cam 82. The thread tension cam 82 touches the lower end of a release lever 86 rotatable on a fulcrum shaft 84. When the lifting lever 78 is operated, the release lever 86 rotates against the force of a spring 88.

A convex 90 is formed on the release lever 86. When the lifting lever 78 rotates clockwise as shown by the arrow B in FIG. 4, and the presser foot 70 rises, the convex 90 turns on a presser-foot detecting switch 92. The upper end of the release lever 86 engages one end of a rotatable linkage 94. The other end of the rotatable linkage 94 engages with a release board 96 supported on the sewing-machine frame 68. The rotatable linkage 94 and the release board 96 can horizontally slide.

When the lifting lever 78 and the rotatable linkage 94 rotate clockwise, the release board 96 slides in the direction indicated by an arrow A in FIG. 4. A pair of tension discs 98 separates against the force of a tension spring 100. On the other hand, when the release board 96 slides in the direction opposite to the arrow A, the tension spring 100 puts the tension discs 98 in contact, and thread is held between the tension discs 98. During sewing operation the tension of the thread between the tension discs 98 is thus regulated.

Figure 7:
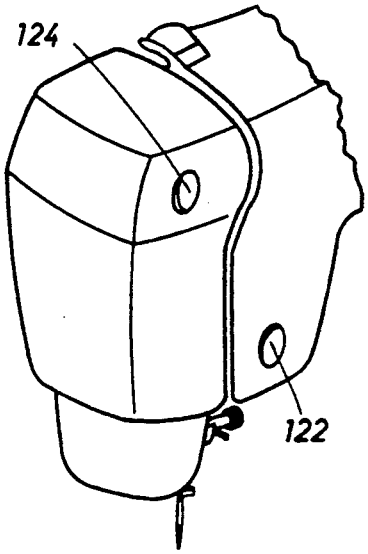
FIG. 7 is a partial perspective view of the sewing machine showing the arrangement of switches for the embodiment.
Figure 6:
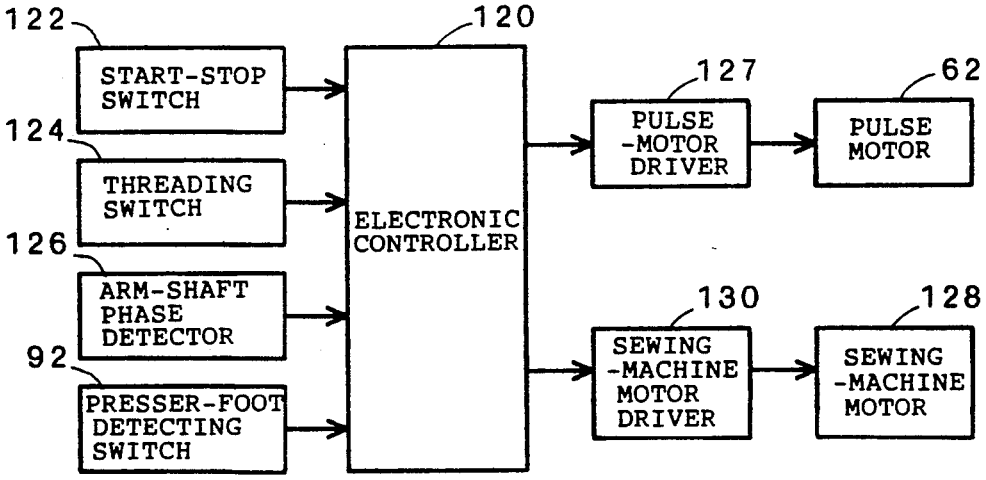
FIG. 6 is a schematic diagram of an electric control circuit for the embodiment.

As shown in the schematic diagram in FIG. 6, an electronic controller 120 controls the automatic threading device for the embodiment. The presser-foot detecting switch 92, a start-stop switch 122, a threading switch 124 and an arm-shaft phase detector 126 are connected to the electronic controller 120. When the arm shaft 1 rotates until the needle bar 10 rises to its uppermost position, and then further rotates by 30 degrees, the arm-shaft phase detector 126 detects the corresponding rotational position of the arm shaft 1 and sends a detection signal to the electronic controller 120. The electronic controller 120 transmits a control signal to a pulse-motor driver 127 and a sewing-machine motor driver 130. The pulse-motor driver 127 transmits pulses to the pulse motor 62 corresponding to the control signal from the electronic controller 120. The sewing-machine motor driver 130 transmits pulses to a sewing-machine motor 128 corresponding to the control signal from the electronic controller 120. The sewing-machine motor 128 drives and rotates the arm shaft 1. As shown in FIG. 7, the start-stop switch 122 and the threading switch 124 are positioned on the front panel of the sewing machine for easy access.

Figure 8:
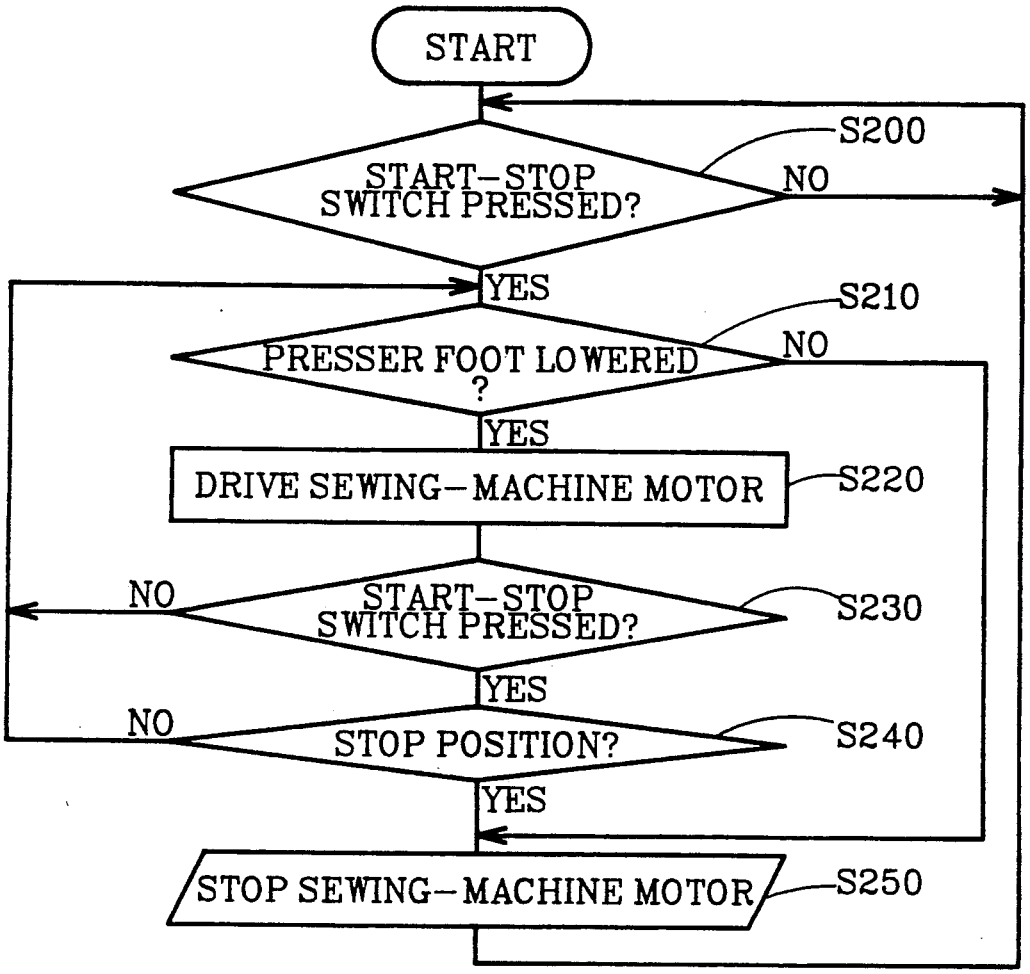
FIG. 8 is a flow chart of sewing operation executed in the control circuit for the embodiment.

In operation, as shown in the flowchart of FIG. 8, after a power switch (not shown) on the sewing machine is turned on and the sewing machine is ready to operate, step S200 determines whether the start-stop switch 122 is pressed. If at step S200 the start-stop switch 122 is pressed, step S210 determines whether the presser foot 70 is lowered. If the presser-foot detecting switch 92 is off, step S210 determines that the presser foot 70 is lowered and holds the cloth steady. Subsequently, step S220 drives the sewing-machine motor 128.

When the sewing-machine motor 128 is driven, the arm shaft 1 is rotated. The rotation of the arm shaft 1 is transmitted through the counterbalance 2, the connecting rod 6 and the needle bar connecting stud 8 to the needle bar 10. The needle bar 10 and the needle 18 vertically move, and the cloth is thus sewn. Processes at steps S200 through S220 are repeated until the start-stop switch 122 is again pressed. Step S230 determines whether the start-stop switch 122 is pressed. If at step S230 the start-stop switch 122 is pressed, step S240 determines whether the sewing machine is in stop position. Specifically, at step S240 the arm-shaft phase detector 126 detects that the arm shaft 1 rotates until the needle bar 10 reaches its uppermost position, further rotates by 30 degrees and is stopped. After the stop position is thus detected, step S250 stops the sewing-machine motor 128. After step S250, processes at S200 through S240 are repeated.

If just after the start-stop switch 122 is pressed or during the sewing operation, at step S210 the presser-foot detecting switch 92 detects the presser-foot 70 is not lowered, step S250 stops the sewing-machine motor 128, thereby avoiding improper sewing operation.

Figure 9:
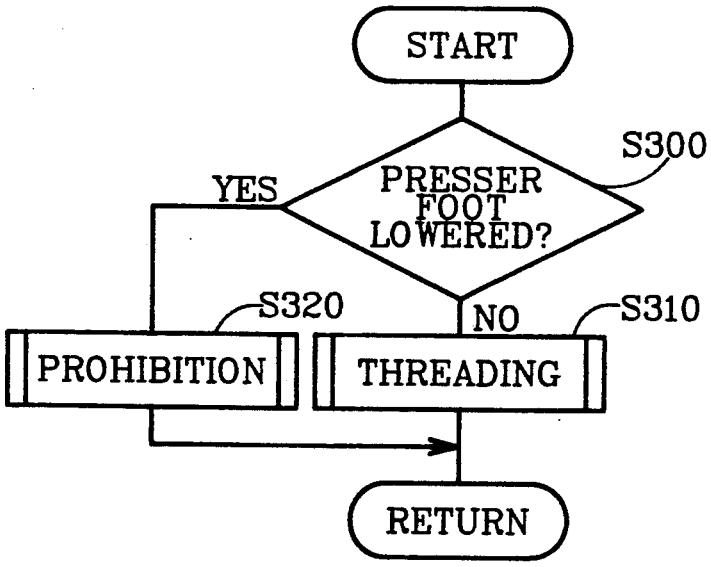
FIG. 9 is a flow chart of threading routine interrupting the sewing operation, executed in the control circuit for the embodiment.

When the threading switch 124 is pressed during the sewing processes at steps S200 through S250, interrupting threading processes are executed according to the flow chart in FIG. 9.

When an operator presses the threading switch 124 before the operator presses the start-stop switch 122 to start sewing operation or if the thread breaks during the sewing operation, the eye 18*a* in the needle 18 is threaded according to the flow chart in FIG. 9.

First, the operator raises the lifting lever 78 clockwise as shown by the arrow B in FIG. 4. The presser-bar lifter cam 80 of the lifting lever 78 pushes up the presser-bar connecting stud 74, and the presser bar 66 and the presser foot 70 rise. On the other hand, the thread tension cam 82 of the lifting lever 78 rotates the release lever 86. The rotation of the release lever 86 is transmitted to the rotatable linkage 94, the release board 96 moves against the force of the tension spring 100, and the tension discs 98 become apart. New thread can thus easily be put between the tension discs 98. When the release lever 86 rotates, the presser-foot detecting switch 92 turns on. In the embodiment, if at step S210 the lifting lever 78 is pushed up, the sewing-machine motor 128 can be stopped without pressing the start-stop switch 122.

After the presser foot 70 is raised and the threading switch 124 is pressed, the interrupting threading routine starts. First, step S300 determines whether the presser foot 70 is lowered in the same way as step S210. If the presser-foot detecting switch 92 is on, step S300 determines that the presser foot 70 is raised. Subsequently, step S310 executes the threading procedure.

Specifically, the sewing-machine motor 128 is driven, the arm shaft 1 is rotated, and the needle bar 10 reaches its uppermost position. When the needle bar 10 reaches its uppermost position, the arm shaft 1 is stopped. When the needle bar 10 is in its uppermost position as shown in FIG. 1, the signal with a predetermined number of pulses is sent to the pulse motor 62. The pulse motor 62 is thus rotated. The rotation of the pulse motor 62 is transmitted through the worm gear 64, the helical gear 60, the pinion 58, and the rack 56 to the moving board 48. The moving board 48 lowers along the guide bar 46.

The moving board 48 lowers the predetermined distance L, the projection 54 of the moving board 48 touches the contact surface 38 of the actuating rod 32, and the actuating rod 32 lowers against the force of the spring 40. The compression spring 34, the guide slot 36, and the actuating pin 30 also lower, thereby lowering the threading rod 24, the linkage 28, and the threading hook 26.

When the threading rod 24 lowers, the actuating pin 30 lowers. The end of the actuating pin 30 contacts the projection 20*a* of the positioning stopper 20 to stop the threading rod 24. Since the arm shaft 1 is stopped, no rotation of the arm shaft 1 is transmitted through the connecting rod 6 and the needle bar connecting stud 8 to the needle bar 10. Therefore, the needle bar 10 is stopped, and the threading rod 24 is prevented from lowering further. When the moving board 48 further lowers, the actuating rod 32 lowers against the force of the compression spring 34, and the actuating pin 30 moves along the guide slot 36. The threading rod 24 is thus rotated.

Figure 5:
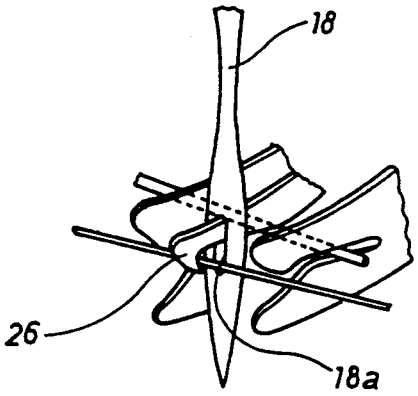
FIG. 5 is a perspective view of a threading hook coming through an eye in a needle for the embodiment.

When the threading rod 24 rotates, the linkage 28 rotates the threading hook 26. As shown in FIG. 5, the threading hook 26 enters the eye 18*a* in the needle 18.

When the threading hook 26 enters the eye 18*a*, the pulse motor 62 receives the signal with the predetermined number of pulses and rotates in reverse. Therefore, the moving board 48 rises, and the actuating rod 32 also rises by using the tensile force of the spring 40. The guide slot 36 rises, and the actuating pin 30 rotates the threading rod 24 in reverse. The linkage 28 rotates the threading hook 26, and the threading hook 26 comes out of the eye 18*a*. When the threading hook 26 is withdrawn from the eye 18*a*, one end of the thread caught in the threading hook 26 is drawn into and through the eye 18*a*.

Subsequently, the moving board 48 further rises, the actuating rod 32 further rises by using the tensile force of the spring 40, and the actuating pin 30 engages in the lower end of the guide slot 36 and raises the threading rod 24. The pulse motor 62 rotates according to the signal with the predetermined number of pulses, and the moving board 48 reaches its uppermost position. The threading rod 24 and the actuating rod 32 also rise. The operator draws one end of the thread from the eye 18*a*, thus finishing the threading operation.

On the other hand, if the threading switch 124 is pressed without pushing up the lifting lever 78, for example, during sewing operation, step S300 determines the presser foot 70 is lowered because the presser-foot detecting switch 92 is off. Subsequently, step S320 executes prohibition procedure. Specifically, the pulse motor 62 is prohibited from operating by interrupting the flow of electric current in a circuit with a relay or other member, or the pulse motor 62 is controlled with a prohibition flag. Alternatively, by skipping the routine at step S310, the process is returned to the beginning of the interrupting threading routine when the threading switch 124 is pressed.

As aforementioned, in the automatic threading device of the embodiment, the pulse motor 62 is driven, the threading rod 24 is lowered and rotated, and the threading hook 26 is automatically inserted into the eye 18*a* in the needle 18. When the presser-foot detecting switch 92 is off and step S300 determines the presser foot 70 is lowered, the operation of the threading rod 24 by the pulse motor 62 is prohibited at step S320.

Consequently, even if the operator by mistake presses the threading switch 124, for example, in the course of sewing operation when the presser foot 70 is lowered and threading operation cannot be carried out, the pulse motor 62 fails to operate so that the threading hook 26 is prevented from being damaged. Since incorrect operation is thus avoided, the threading switch 124 can be provided on the front panel of the sewing machine, near the start-stop switch 122, or other position easy to access.

In the embodiment, step S300 determines whether sewing operation is carried out by detecting the presser foot 70 is lowered with the presser-foot detecting switch 124. However, step S300 can determine whether sewing operation is carried out by detecting whether the sewing-machine motor 128 operates or not. The operation of the sewing-machine motor 128 can be detected by determining whether the arm-shaft phase detector 126 continuously sends out a predetermined signal or not. Alternatively, the operation of the sewing-machine motor 128 can be detected by an encoder or the like, or by detecting whether electric current flows in the sewing-machine motor 128 or not.

If at step S300 the sewing-machine motor 128 is not operated, step S310 executes the threading routine. If at step S300 the sewing-machine motor 128 operates, step S310 executes the prohibition routine. Even if the operator by mistake presses the threading switch 124 during sewing operation when the sewing-machine motor 128 is operated, the pulse motor 62 fails to operate, thus preventing the threading hook 26 from damaging. Therefore, the threading switch 124 can be provided on the front panel of the sewing machine, near the start-stop switch 122 or other position easy to access.

This invention has been described above with reference to the preferred embodiment. Modifications and alterations may become apparent to one skilled in the art upon reading and understanding the specification. It is intended to include all such modifications and alterations within the scope of the appended claims.

What is claimed is:

1. An automatic threading apparatus for a sewing machine having a needle for sewing a cloth, a motor for driving the needle to sew the cloth, and a presser foot for pressing the cloth to hold the cloth steady when the needle is sewing the cloth, comprising:

a threading rod supported by the sewing machine such that the threading rod is movable along and rotatable about an axis of the threading rod;

drive means for moving the threading rod along and rotating the threading rod about the threading rod axis;

threading means attached to one end of the threading rod, wherein the threading means extends a threading hook into an eye of the needle when the drive means moves the threading rod along the threading rod axis and rotates the threading rod about the threading rod axis;

detection means for detecting that the motor is driving the needle; and p1 prohibiting means for prohibiting the drive means from lowering the threading rod when the detection means detects that the motor is driving the needle.

2. The automatic threading apparatus of claim 1, wherein the sewing machine further comprises:

an arm shaft for connecting the motor to a needle bar on which the needle is mounted such that revolution of a shaft of the motor rotates the arm shaft, which in turn reciprocates the needle bar up and down; and arm shaft phase detecting means for continuously sending signals indicating the phase of the arm shaft while the arm shaft is rotating; wherein the detection means detects that the motor is driving the needle when the arm shaft is continuously sending signals.

3. The automatic threading apparatus of claim 1, wherein the detection means detects that the motor is driving the needle using an encoder.

4. The automatic threading apparatus of claim 1, wherein the detection means detects that the motor is driving the needle by detecting whether current is flowing in the motor.

5. A threading apparatus for a sewing machine having a needle bar, a needle attached to one end of the needle bar, a sewing transmission for moving the needle bar, and a presser foot for pressing a cloth to hold the cloth steady when the needle is sewing the cloth, the threading apparatus comprising:

a threading rod mounted in parallel to the needle bar such that the threading rod is movable along and rotatable about an axis of the threading rod;

threading means attached to a first end of the threading rod for extending a threading hook when the threading rod rotates about the threading rod axis;

actuating means mounted on a second end of the threading rod for rotating the threading rod about the threading rod axis when the threading rod is in a threading position adjacent to the needle;

drive means for moving a drive board relative to the needle bar towards the threading position, wherein the drive board contacts the actuating means to move the actuating means and threading rod towards the threading position;

stop means mounted on the needle bar for stopping the threading rod when the threading rod is in the threading position;

detection means for detecting a position of the presser foot; and prohibiting means for prohibiting the drive means from lowering the threading rod when the detection means detects that the presser foot is in a position for pressing cloth.

6. The automatic threading apparatus of claim 3, wherein the detection means detects that the needle is sewing the cloth by detecting that the presser foot is in a position for pressing the cloth.

7. The automatic threading apparatus of claim 6, further comprising:

presser foot raising means for moving between a first position and a second position, wherein the presser foot raising means moves the presser foot away from the cloth when the presser foot raising means moves towards the first position, and the presser foot raising means moves the presser foot into the position for pressing the cloth when the presser foot raising means moves towards the second position; wherein the detection means is an electrical switch located adjacent to the presser foot raising means such that the presser foot raising means turns on the electrical switch when the presser foot raising means is in the first position; and the prohibiting means prohibits the drive means from lowering the threading rod when the presser foot raising means is in the second position.

8. The automatic threading apparatus of claim 7, wherein the presser foot raising means comprises:

a lifting lever rotatable about a fulcrum point;

a presser bar lifter cam mounted on the lifting lever for raising the presser foot when the lifting lever is rotated in a lifting direction about the fulcrum point;

a thread tension cam for rotating a release lever to force apart tension discs that apply tension to a thread when together; and a convexity formed on the thread tension cam for contacting and turning on the electrical switch when the lifting lever is rotated in the lifting direction.

9. The threading apparatus of claim 8, wherein the drive means further comprises:

a drive source for providing rotational motion; and a transmission for transferring the rotational motion of the drive source into linear motion for driving the drive board.

10. The automatic threading apparatus of claim 5, wherein the detection means detects that the needle is sewing the cloth by detecting that the motor is driving the needle.

11. The automatic threading apparatus of claim 10, wherein the sewing machine further comprises:

an arm shaft for connecting the motor to a needle bar on which the needle is mounted such that revolution of a shaft of the motor rotates the arm shaft, which in turn reciprocates the needle bar up and down; and arm shaft phase detecting means for continuously sending signals indicating the phase of the arm shaft while the arm shaft is rotating; wherein the detection means detects that the motor is driving the needle when the arm shaft is continuously sending signals.

12. The automatic threading apparatus of claim 10, wherein the detection means detects that the motor is driving the needle using an encoder.

13. The automatic threading apparatus of claim 10, wherein the detection means detects that the motor is driving the needle by detecting whether current is flowing in the motor.

14. The automatic threading apparatus of claim 10, wherein the drive means further comprises:

a drive source for providing rotational motion; and a transmission for transferring the rotational motion of the drive source into linear motion for driving the drive board.

15. A sewing machine having a threading apparatus comprising:

a reciprocable needle having an eye for sewing a cloth;

a presser foot movable between a first position and a second position, said presser foot being separated from the cloth when the presser foot is at the first position and the presser foot presses the cloth so as to hold the cloth steady when the presser foot is at the second position;

a threading rod supported by the sewing machine such that the threading rod is movable along and rotatable about an axis of the threading rod;

threading means attached to one end of the threading rod, the threading means extending a threading hook into the eye of the needle when the threading rod is moved along the axis of the threading rod and rotated about the axis of the threading rod;

detection means for detecting a position of the presser foot; and prohibiting means for prohibiting the threading rod from moving along the axis of the threading rod when the detection means detects that the presser foot is at the second position.

* * * * *